US007278834B2

(12) United States Patent
Herrick et al.

(10) Patent No.: US 7,278,834 B2
(45) Date of Patent: Oct. 9, 2007

(54) COMPRESSOR ASSEMBLIES WITH IMPROVED MOUNTING SUPPORT AND METHOD OF MOUNTING SUCH COMPRESSOR ASSEMBLIES

(75) Inventors: Todd W. Herrick, Tecumseh, MI (US); Rick L. Bunch, Tecumseh, MI (US); Sukru Erisgen, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 782 days.

(21) Appl. No.: 10/760,815

(22) Filed: Jan. 20, 2004

(65) Prior Publication Data

US 2005/0158185 A1 Jul. 21, 2005

(51) Int. Cl.
*F04B 39/12* (2006.01)

(52) U.S. Cl. ..... 417/363; 248/638

(58) Field of Classification Search ..... 417/363; 248/638; 62/295

See application file for complete search history.

(56) References Cited

U.S. PATENT DOCUMENTS

| | | | | | |
|---|---|---|---|---|---|
| 3,486,688 | A | * | 12/1969 | Hofvendahl | 415/119 |
| 4,842,095 | A | * | 6/1989 | Rozek | 248/638 |
| 4,964,609 | A | * | 10/1990 | Tomell | 248/638 |
| 4,966,755 | A | | 10/1990 | Smith | 422/28 |
| 5,582,508 | A | | 12/1996 | Chou | 417/32 |
| 5,689,969 | A | | 11/1997 | Conroy | 62/262 |
| 5,911,742 | A | | 6/1999 | Akazawa | 62/78 |
| 5,943,872 | A | | 8/1999 | Sakurada et al. | 62/262 |
| 5,974,824 | A | | 11/1999 | Galockin et al. | 62/394 |
| 6,011,336 | A | * | 1/2000 | Mathis et al. | 417/363 |
| 6,062,033 | A | | 5/2000 | Choi | 62/296 |
| 6,221,120 | B1 | | 4/2001 | Bennington et al. | 55/385.1 |
| 6,337,015 | B1 | | 1/2002 | Poirier | 210/232 |
| 6,393,854 | B1 | | 5/2002 | Scheuer et al. | 62/277 |
| 6,432,497 | B2 | | 8/2002 | Bunyan | 428/40.1 |

OTHER PUBLICATIONS

3M VHB™ Acrylic Foam Tape, product information, 5 pages, 2002 and 1995-2004.

Foam-Tech, What's the Difference Between Open-Cell and Closed-Cell Urethane Foams?, 2 pages, Building Envelope Solutions, Inc., 2002.

* cited by examiner

*Primary Examiner*—Michael Koczo, Jr.
(74) *Attorney, Agent, or Firm*—Baker & Daniels LLP

(57) ABSTRACT

A compressor assembly including a housing, a motor operatively linked to a compressor mechanism, a support structure, and a sheet of closed cell foam material. The motor and compressor mechanism are disposed within the housing. The housing, motor, and compressor mechanism define a compressor assembly weight. The foam material includes a first and an opposite second surface. The first and second surfaces are adhered to the housing and support structure, respectively, and substantially all of the compressor assembly weight is supported by the foam material. A method of mounting a compressor assembly including coupling a motor and a compressor mechanism, mounting the motor and compressor mechanism within a housing, and mounting the housing to a support structure wherein a sheet of closed cell foam material is disposed between the housing and the support structure and substantially all of the compressor assembly weight is supported by the foam material.

15 Claims, 6 Drawing Sheets

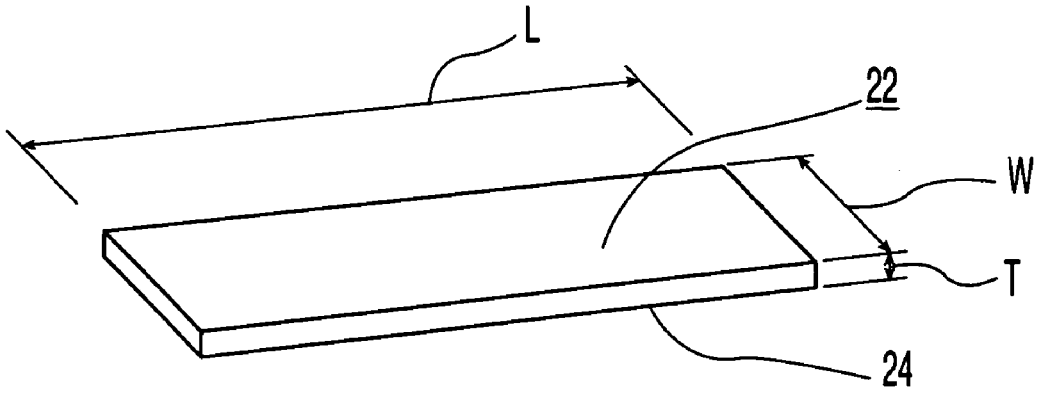
*Fig. 3*
*Fig. 4*
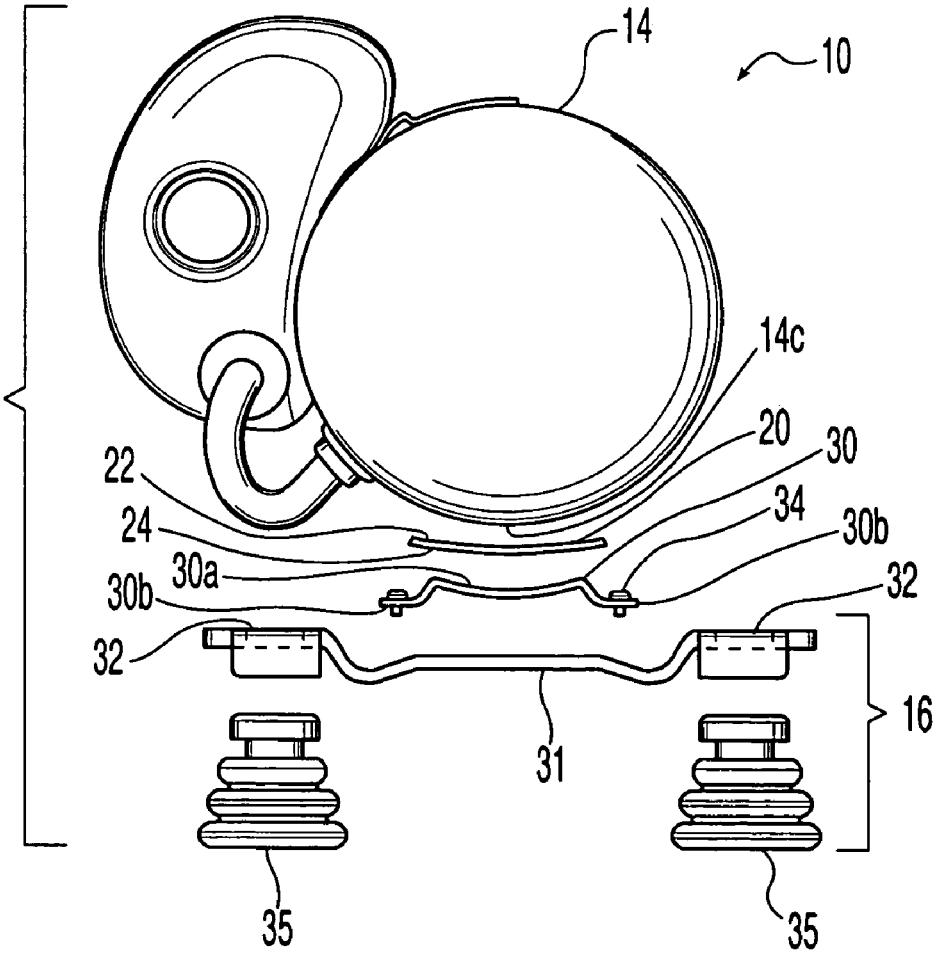

COMPRESSOR ASSEMBLIES WITH IMPROVED MOUNTING SUPPORT AND METHOD OF MOUNTING SUCH COMPRESSOR ASSEMBLIES

BACKGROUND OF THE INVENTION

1. Field of the Invention

The present invention relates to hermetic compressor assemblies and methods of assembling the same.

2. Description of the Related Art

Compressor assemblies commonly include a motor and a compression mechanism, both of which are housed within the interior plenum of a hermetically sealed, substantially cylindrical housing, which is specifically formed to accommodate the motor and compression mechanism. The motor and compression mechanism are often heat shrink-fitted within the housing to achieve a tight fit. This tight fit is often necessary to define suction plenums and/or discharge plenums within the interior plenum of the housing. The housings are typically made from steel and are often mounted on, and supported by, support structures such as feet or mounting brackets, which may be further supported on a final assembly. The support structures are typically affixed to the outer surface of the housing using welding techniques, which involve applying high heat to seal or fuse the metal parts together. In addition, other metal parts may be welded to the outer surface of the housing, including terminal assembly covers, terminal fences, and accumulators. Unfortunately, these welding techniques can result in the deformation of the parts being welded. In particular, welding can deform the housing, thereby altering its original shape and structure. This deformation may cause interference in the tight fit between the motor-compression mechanism and the housing and, ultimately, result in leaks between the separate plenums defined within the housing interior.

The motor and compression mechanism of known compressor assemblies include multiple moving parts that cause vibrations. These vibrations are often transferred from the motor, compression mechanism, and/or interior plenum to the housing, mounting brackets, feet and/or the final assembly. These vibrations can result in undesirable noise. Rubber grommets have been attached to the feet or mounting brackets to minimize the noise.

A need remains for a compressor assembly and method of assembling the same that does not deform the parts of the compressor assembly and/or reduces noise vibrations.

SUMMARY OF THE INVENTION

The present invention provides a compressor assembly that, in one form, includes a hermetically sealed housing, a motor operatively linked to a compressor mechanism, a support structure, and at least one sheet of closed cell foam material. The motor and compressor mechanism are disposed within the housing, and the housing, the motor and the compressor mechanism define a compressor assembly weight. The at least one sheet of closed cell foam material includes a first major surface and a second major surface disposed opposite the first major surface. The first major surface is adhered to the housing, the second major surface is adhered to the support structure and substantially all of the compressor assembly weight is supported by the at least one sheet of closed cell foam material.

The invention also provides a method of mounting a compressor assembly. The method, in one form, includes operably coupling a motor and a compressor mechanism, mounting the motor and compressor mechanism within a housing, hermetically sealing the housing wherein the motor, the compressor mechanism and the housing define a compressor assembly weight, and mounting the housing to a support structure wherein at least one sheet of closed cell foam material is disposed between the housing and the support structure and substantially all of the compressor assembly weight is transferred to the support structure through the at least one sheet of closed cell foam material.

An advantage of the present invention is that it provides a mounting for a compressor assembly that does not require welding of the compressor housing and the potential distortions of the compressor housing that accompany such welding procedures.

Another advantage of the present invention is that it provides a mounting for a compressor assembly that provides a vibrational damping function.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 3 is a perspective view of a sheet of closed cell foam material used in the compressor assembly of FIG. 2;

FIG. 4 is an end view of a compressor assembly according to another embodiment of the present invention;

Figure 1:
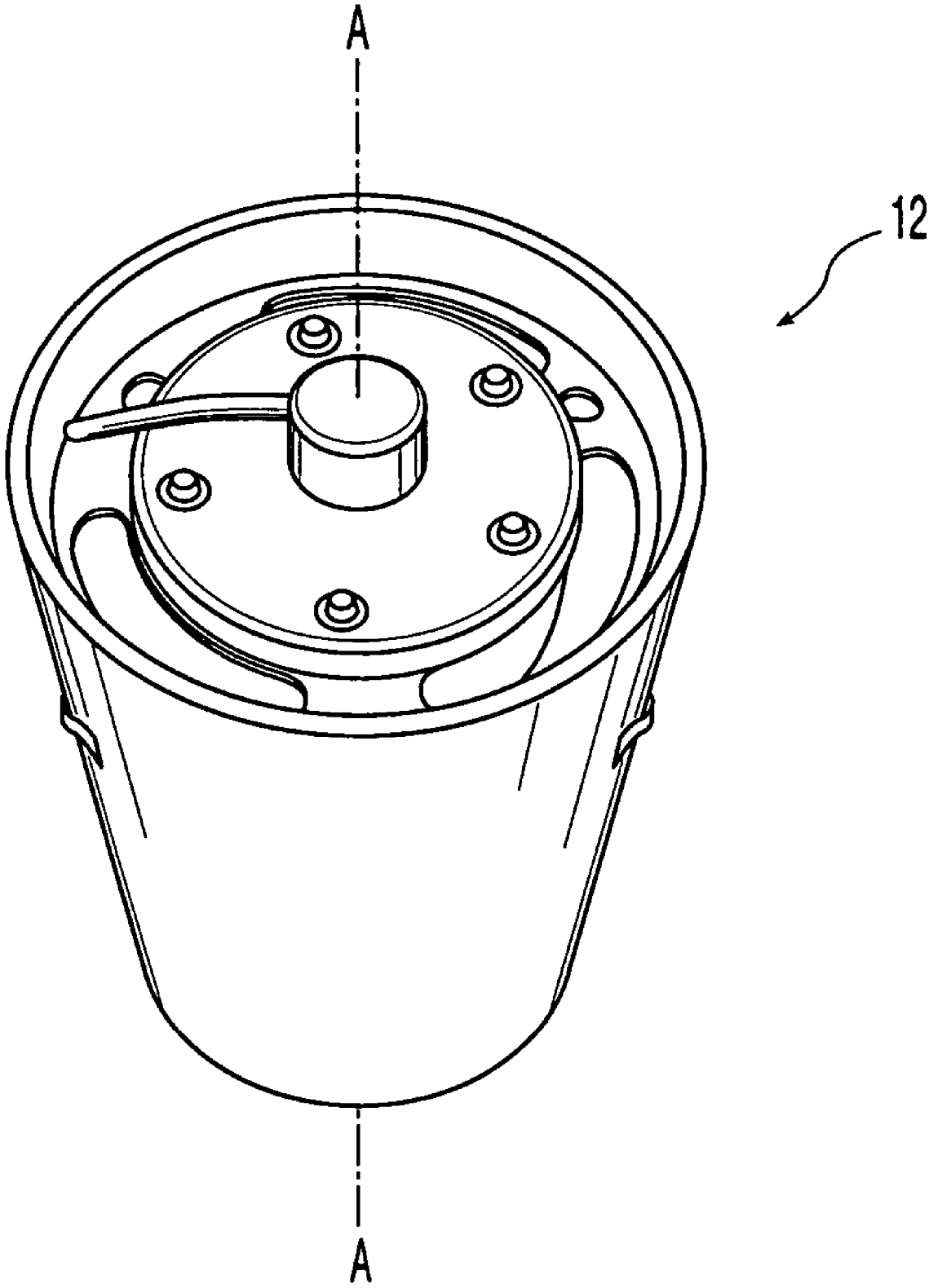
FIG. 1 is a perspective view of motor-compressor mechanism according to the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Figure 2:
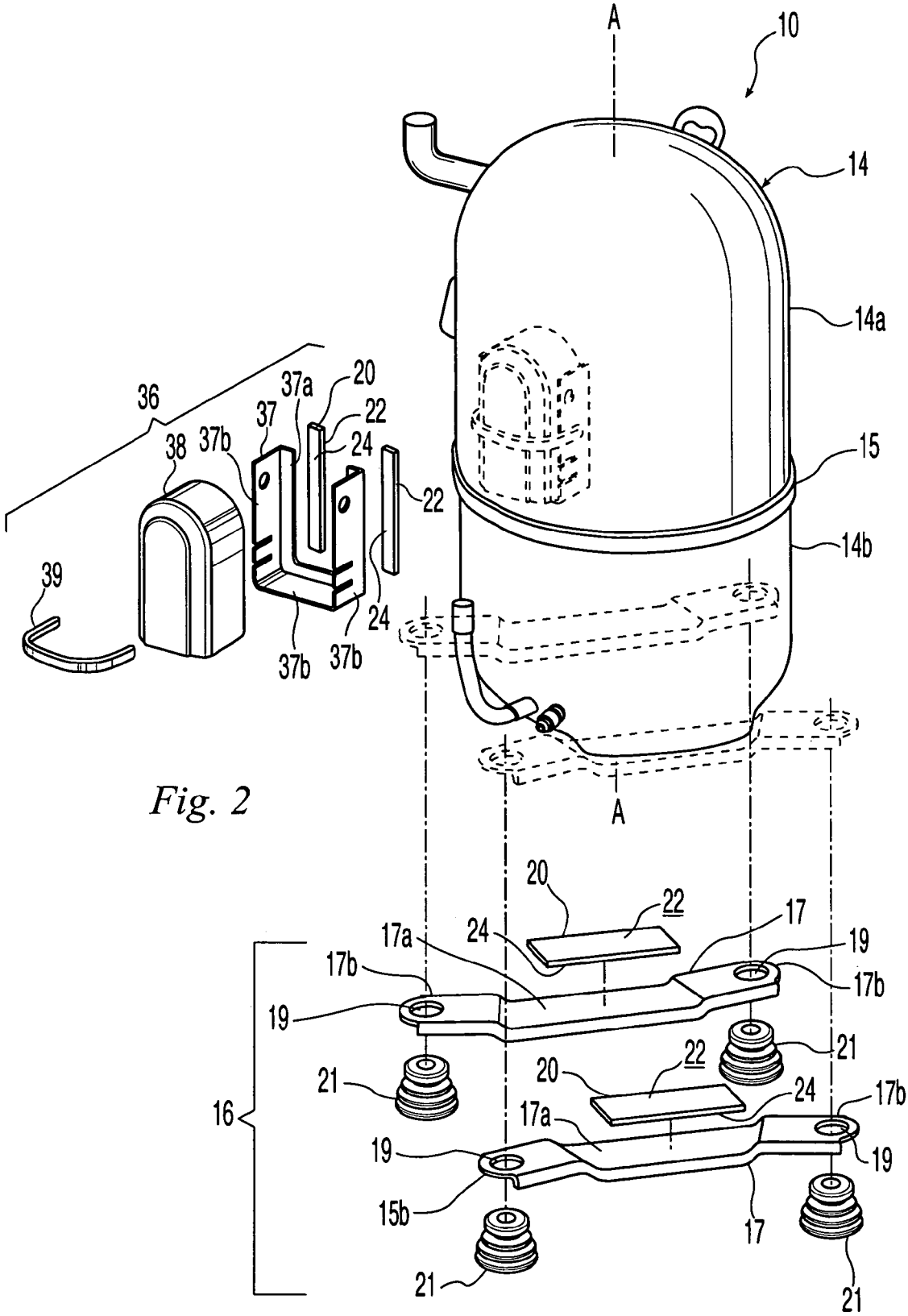
FIG. 2 is a perspective view of a compressor assembly according to the present invention.
Figure 5:
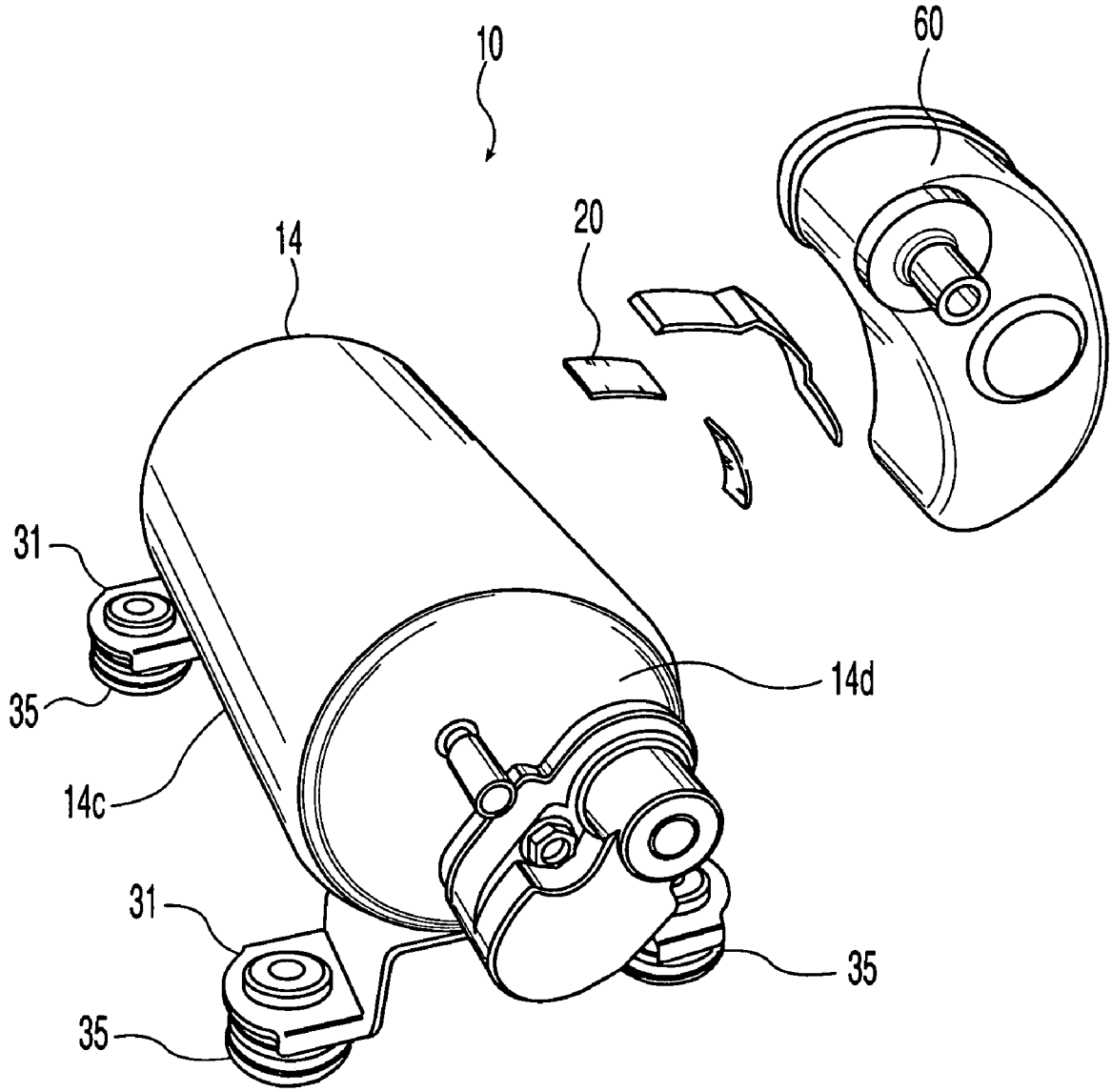
FIG. 5 is a perspective view of the compressor assembly of FIG. 4.
Figure 6:
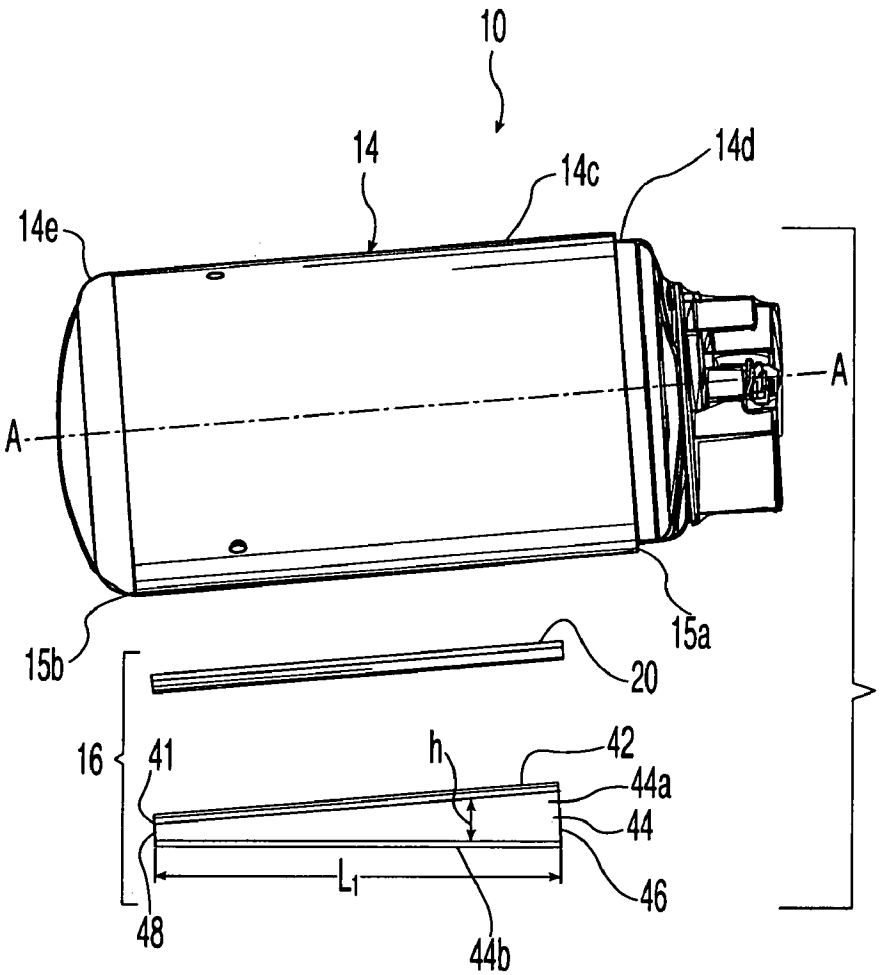
FIG. 6 is a side view of a compressor assembly according to another embodiment of the present invention.

Referring first to FIGS. 1, 2, 5 and 6, compressor assembly 10 includes a motor operatively linked to a compressor mechanism to form motor-compressor mechanism assembly 12. Motor-compressor mechanism assembly 12 defines a rotational axis A-A and is disposed within a substantially cylindrical, hermetically sealed housing 14 having an axis concentric to axis A-A. Housing 14 may be formed of multiple parts, each formed of sheet steel and hermetically sealed to one another by a method such as welding, brazing or the like. For instance, as shown in FIG. 2, housing 14 includes upper housing member 14*a* and lower housing member 14*b*, each formed from sheet metal and hermetically sealed to one another at overlapping seam 15. Alternatively, as shown in FIG. 6, housing 14 may include cylindrical main member 14*c* and a pair of end members 14*d*, 14*e* positioned on opposite ends of main member 14*c*. Housing members 14*c*, 14*d*, 14*e* are hermetically sealed to one another at overlapping seams 15*a*, 15*b*.

Referring now to FIGS. 2, 4, and 6, housing 14 is mounted on and supported by a support structure 16. As shown in FIG. 2, support structure 16 may include a pair of housing support members 17. Each housing support member 17 includes a housing support portion 17*a* configured to receive lower housing member 14*b*, and feet portions 17*b* extending from opposite ends of housing support portion 17*a*. Lower housing member 14*b* is mounted on housing support portion 17*a* such that compressor assembly 10 and rotational axis A-A are oriented substantially vertical. Rather than welding support structure 16 to housing 14, a sheet of closed cell foam material 20 is positioned between housing support portion 17*a* and housing member 14*b*. Closed cell foam material 20 has a first surface 22, an opposite second surface 24, and a thickness T extending therebetween. First surface 22 is adhered to the surface of lower housing member 14*b* using an adhesive, such as a high bond strength synthetic acrylic, while second surface 24 is adhered to housing support portion 17*a* to secure support member 17 to housing 14. Feet portions 17*b* define openings 19, which may receive rubber grommets 21.

Turning now to FIGS. 4 and 5, support structure 16 may alternatively comprise a pair of mounting brackets 30, each having a housing support portion 30*a* and a pair of legs 30*b* extending perpendicularly from opposite ends of housing support portion 30*a*. Housing support portion 30*a* is configured to receive the surface of housing member 14*c* such that when housing 14 is mounted on brackets 30, the orientation of compressor assembly 10 and rotational axis A-A is substantially horizontal. Foam material 20 is positioned between housing support portion 30*a* and main housing member 14*c*. First surface 22 of foam material 20 is adhered to the surface of main housing member 14*c*, while opposite second surface 24 is adhered to the surface of support portion 30*a* to secure mounting brackets 30 to housing 14. Support structure 16 may also include a pair of base feet 31 to which legs 30*b* of mounting bracket 30 may be secured by fasteners 34, which extend through openings in bracket 30 and engage base feet 31. Base feet 31 may include openings 32 into which rubber grommets 35 may be received.

Figure 7:
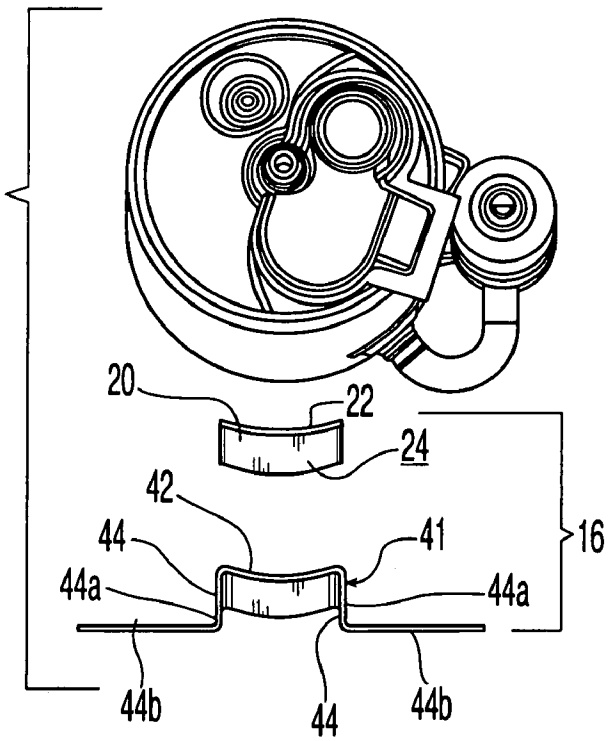
FIG. 7 is an end view of the compressor assembly of FIG. 6.
Figure 8:
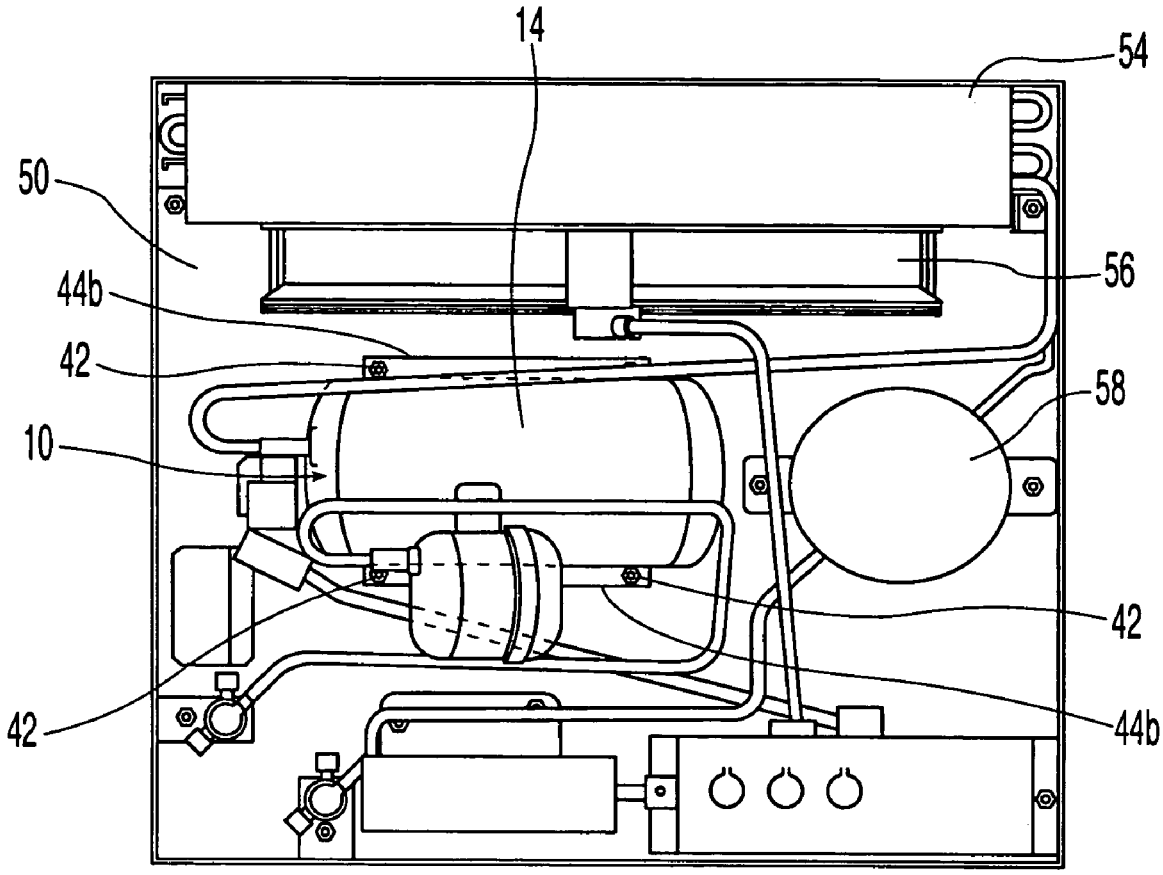
FIG. 8 is a top view of the compressor assembly of FIG. 6 mounted on a base plate.

Turning now to FIGS. 6 and 7, support structure 16 may alternatively comprise a single support member 41. Single support member 41 includes a housing support portion 42 and a pair of L-shaped mounting flanges 44 extending from opposite sides of housing support portion 42. Housing support portion 42 is configured to receive the outer surface of main housing member 14*c*. Support member 41 defines a first end 46, opposite second end 48 and a length $L_1$ extending therebetween. To provide sufficient support for housing 14, length $L_1$ may be equal to the length of a substantial portion of main housing member 14*c*. A strip of foam material 20 is positioned between main housing member 14*c* and housing support portion 41*a*. First surface 22 of foam material 20 is adhered to main housing member 14*c*, while second surface 24 is adhered to housing support portion 42 to secure support member 41 to housing 14. L-shaped mounting flanges 44 define a vertical portion 44*a* extending perpendicularly from housing support portion 42, and a horizontal portion 44*b* extending perpendicularly from the end of vertical portion 44*a* opposite housing support portion 42. As illustrated in FIG. 6, vertical portion 44*a* defines a height h which decreases in size moving from first end 46 to second end 48, thus the orientation of rotational axis A-A has both horizontal and vertical components but is substantially horizontal. Support structure 16 may also include base plate 50 shown in FIG. 8. Horizontal portion 44*b* of flanges 44 are mounted on base plate 50 using fasteners 52. Alternatively, support member 41 may be integrally formed with base plate 50, such that base plate 50 is comprised of the horizontal portions 44*b* of mounting flanges 44. As shown in FIG. 8, additional mechanisms may be mounted to base plate 50 such as heat exchanger 54, fan 56, and/or receiver 58 to form a condensing unit.

The use of closed cell foam material 20 to secure support structure 16 to housing 14 eliminates the need for welding and prevents the deformation of housing 14 caused by the high heat of welding. In addition, closed cell foam material 20 supports substantially all of the combined weight of motor-compressor mechanism assembly 12 and housing 14. As a result, closed cell foam material 20 absorbs some of the vibrations that would otherwise be transferred to housing 14 from the moving parts and moving gas within housing 14, thus resulting in a reduction of noise.

Closed cell foam material 20 also defines a width W and a length L. Width W, length L and thickness T of closed cell foam material 20 may vary, however, it is advantageous if width W, length L and thickness T are such that substantially all of the combined weight of the housing 14 and motor-compressor mechanism assembly 12 is supported by closed cell foam material 20 and that housing 14 does not directly contact support structure 16. Advantageously, width W and length L are substantially equal to the width and length of the support portion of support Structure 16 so as to prevent housing 14 from directly contacting support member 17.

Closed cell foam material 20 may be made from any suitable polymer used to make closed cell foam, including acrylic, polystyrene and polyethylene. The density of the foam can vary but is preferably between 35 $lbs/ft^3$ (561 $kg/m^3$) and 42 $lbs/ft^3$ (673 $kg/m^3$), and more preferably between 37 $lbs/ft^3$ (592 $kg/m^3$) and 40 $lbs/ft^3$ (640 $kg/m^3$). Theoretically, t greater the thickness T of closed cell foam material 20, the more vibrations will be absorbed and the greater the reduction of noise. Consequently, the thickness T may vary depending on factors such as the desired noise reduction, material costs and manufacturing efficiency. Advantageously, thickness T is between about 0.045 inches (1.143 mm) and 0.120 inches (3.048 mm).

Referring back to FIGS. 1-2, compressor 10 includes a terminal assembly (not shown) which connects a power source (not shown) to motor compressor mechanism assembly 12. A terminal cover assembly 36 fits over the terminal assembly to cover and protect the electrical connection. Cover assembly 36 includes fence 37, cover 38 and clip 39. Fence 37 includes a backwall or flange 37*a* and sidewalls 37*b*. Backwall 37*a* is configured to receive the surface of housing 14, while sidewalls 37*b* surround the sides of terminal assembly 40. Cover 38 fits within fence 37 and covers the terminal assembly. Clip 39 extends over cover 38 and snap engages fence 37 to secure cover 38 to fence 37. Rather than welding cover assembly 36 to housing 14, closed cell foam material 20 is positioned between fence backwall 37*a* and housing 14. The first surface 22 of foam material 20 is adhered to housing 14, while second surface 24 is adhered to the surface of backwall 37*a*, thereby securing cover assembly 36 to housing 14. As a result, welding is not needed to connect cover assembly 36 to housing 14 and housing 14 is spared the deformation that often occurs due to the high heat of welding. Furthermore, since welding is not used to attach cover assembly 36 to housing 14, cover assembly 36 including fence 37 may be formed of plastic.

In addition to support structures, mounting brackets, and terminal cover assemblies, closed cell foam materials 20 may be used in a similar manner to mount other objects to housing 14. For instance, as shown in FIG. 5, accumulator 60 may be mounted on housing 14 using closed cell foam material 20.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly, said assembly comprising:

a hermetically sealed housing;

a motor operatively linked to a compressor mechanism, said motor and compressor mechanism being disposed within said housing wherein said housing, said motor and said compressor mechanism define a compressor assembly weight;

a support structure; and at least one sheet of closed cell foam material having a first major surface and a second major surface disposed opposite said first major surface, said first major surface being adhered to said housing, said second major surface being adhered to said support structure and wherein substantially all of said compressor assembly weight is supported by said at least one sheet of closed cell foam material.

2. The compressor assembly of claim 1 wherein said support structure comprises a plurality of mounting brackets, each of said mounting brackets being secured to said housing by a respective one of said at least one sheet of closed cell foam material.

3. The compressor assembly of claim 1 wherein said support structure comprises a single support member.

4. The compressor assembly of claim 3 wherein said single support member is a base plate having a housing support portion configured to receive said housing, said at least one sheet of closed cell foam material being adhered to said housing support portion between said base plate and said housing.

5. The compressor assembly of claim 4 further comprising a heat exchanger mounted to said base plate.

6. The compressor assembly of claim 1 wherein said motor defines a rotational axis and the orientation of said rotational axis is substantially vertical.

7. The compressor assembly of claim 1 wherein said motor defines a rotational axis and the orientation of said rotational axis is substantially horizontal.

8. The compressor assembly of claim 1 wherein said at least one sheet of closed cell foam material has a density of between about 561 $kg/m^3$ and 673 $kg/m^3$.

9. The compressor assembly of claim 1 wherein said at least one sheet of closed cell foam material has a density of between about 592 $kg/m^3$ and 640 $kg/m^3$.

10. The compressor assembly of claim 9 wherein said at least one sheet of closed cell foam material has a thickness of between about 1.1 mm and 3.0 mm.

11. A method of mounting a compressor assembly, said method comprising:

operably coupling a motor and a compressor mechanism and mounting the motor and compressor mechanism within a housing;

hermetically sealing the housing wherein the motor, the compressor mechanism and the housing define a compressor assembly weight; and mounting the housing to a support structure wherein at least one sheet of closed cell foam material is disposed between the housing and the support structure and substantially all of the compressor assembly weight is transferred to the support structure through the at least one sheet of closed cell foam material.

12. The method of claim 11 wherein mounting the housing to a support structure comprises securing the housing to a plurality of mounting brackets wherein one of the at least one sheet of closed cell foam material is disposed between the housing and each of the plurality of mounting brackets.

13. The method of claim 11 wherein the support structure is a base plate having a housing support portion configured to receive the housing and the at least one sheet of closed cell foam material is disposed between the housing support portion and the housing and the method further comprises mounting a heat exchanger to the base plate.

14. The method of claim 11 wherein the motor defines a substantially vertically oriented rotational axis.

15. The method of claim 11 wherein the motor defines a substantially horizontally oriented rotational axis.

* * * * *